US006340254B1

(12) United States Patent
Ono

(10) Patent No.: US 6,340,254 B1
(45) Date of Patent: Jan. 22, 2002

(54) IMAGE FORMING APPARATUS WITH AN IMPELLING ROLLER TO BE PRESSED AGAINST A PLATEN ROLLER

(75) Inventor: Kinya Ono, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/559,666

(22) Filed: Apr. 28, 2000

(30) Foreign Application Priority Data

May 10, 1999 (JP) ..... 11-128795

(51) Int. Cl.[7] ..... B41J 11/16; B41J 11/18; B41J 25/304; B41F 15/00

(52) U.S. Cl. ..... 400/120.16; 400/617; 347/220; 101/114

(58) Field of Search ..... 101/114, 116; 400/120.16, 611, 613, 617; 347/197, 220

(56) References Cited

U.S. PATENT DOCUMENTS 5,052,836 A * 10/1991 Genno ..... 400/629
5,188,029 A * 2/1993 Sugimoto et al. ..... 400/692
6,092,945 A * 7/2000 Takami et al. ..... 400/692

FOREIGN PATENT DOCUMENTS

| | | |
|---|---|---|
| JP | 58016872 | 1/1983 |
| JP | 61290072 | 6/1985 |
| JP | 61241175 | 10/1986 |
| JP | 09039315 | 2/1997 |

* cited by examiner

*Primary Examiner*—Daniel J. Colilla
(74) *Attorney, Agent, or Firm*—Nath & Associates PLLC; Gary M. Nath; Marvin C. Berkowitz

(57) ABSTRACT

An image forming apparatus of the present invention is provided with a platen roller, a head capable of being pressed against the platen roller and forming an image onto a recording medium, a first impelling member impelling so as to press the head against the platen roller, an impelling roller capable of being pressed against the platen roller, and a second impelling member impelling so as to press the impelling roller against the platen roller. Here, while the head is pressed against the platen roller by use of the first impelling member and the recording medium supplied between the head and the platen roller is pressed, and while the impelling roller is pressed against the platen roller by use of the second impelling member, the recording medium is transported as the image is formed on the recording medium.

11 Claims, 6 Drawing Sheets

IMAGE FORMING APPARATUS WITH AN IMPELLING ROLLER TO BE PRESSED AGAINST A PLATEN ROLLER

BACKGROUND OF THE INVENTION

1. Field of the Invention

The present invention relates to an image forming apparatus, and more particularly to an image forming apparatus that transports a stencil sheet corresponding to a recording medium and supplied between a head and a platen roller, by rotation of the platen roller, as the apparatus forms a perforated image on the stencil sheet.

2. Description of the Related Art

In known stencil printing machines in the past, a stencil sheet is melted in accordance with image information of an original to be printed, causing holes therein, the thus perforated stencil sheet being used to print the image information onto a printing paper.

In the above type of stencil printing machine, the formation of perforations in the stencil sheet by melting is done by a stencil making unit, which functions as an image forming apparatus for the perforation image.

The type of image forming apparatus studied by the inventor is described below.

In FIG. 1, a platen roller 1 is fixed by support shafts 2 that protrude on both sides thereof. The protruding ends of the support shafts 2 are rotatably supported by the main apparatus (not shown in the drawing). The support shafts 2 are linked to a platen rotational drive motor (not shown in the drawing), the rotational drive of the platen rotational drive motor causing the platen roller 1 to rotate.

A thermal head 3 (thermal printing head) melts the stencil sheet 4 in accordance with the image information to form perforations therein, and is fixed to a head support member 5.

The head support member 5 is swingably supported to the main apparatus by a shaft a about which it swings. The swinging of the head support member 5 freely moves the thermal head 3 with respect to the platen roller 1 in the contact and retraction directions indicated by the arrow A.

One end of a first spring 6 is engaged with the head support member 5. The spring force of the first spring 6 impels the thermal head 3 so that it is pressed against the platen roller 1.

A pressure adjustment cam 8 is fixed to the output shaft of a head pressure adjustment motor 7.

The pressure adjustment cam 8, in response to the force from the pressure adjustment motor 7, rotates freely in the direction shown by the arrow B, and the rotational position thereof establishes engagement and disengagement with respect to the head support member 5.

That is, when the pressure adjustment cam 8 rotates so that its longitudinal direction makes contact with the bottom surface 5*a* of the head support member 5 in the direction Z that is perpendicular to the Y direction, which is the width direction of the head support member 5 as shown in FIG. 1, the pressure adjustment cam 8 presses up against the bottom surface 5*a* of the head support member 5, and the head support member 5 resists the spring force of the first spring 6, rotating in the clockwise direction as shown in FIG. 1. Therefore, the thermal head 4 fixed to the head support member 5 moves to a position that is retracted from the platen roller 1.

When the pressure adjustment cam 8 rotates so that its longitudinal direction moves from the Z direction to the Y direction, the pressure of the pressure adjustment cam 8 up against the head support member 5 is released, so that, by means of the spring force of the first spring 6, the head support member 5 rotates in the counterclockwise direction shown in FIG. 1. Therefore, the thermal head 3 moves to a position that comes into pressure contact with the platen roller 1.

In the above-noted configuration, when the thermal head 3 is at a position that is retracted from the platen roller 1, the stencil sheet 4 is fed between the thermal head 3 and the platen roller 1.

Next, when the stencil making mode, this being the image forming mode, is selected, the head pressure adjustment motor 7 provides drive, so that the thermal head 3 moves from the position in which it is retracted from the platen roller 1 to the position at which it is pressed up against the platen roller 1, the stencil sheet 4 coming into contact between the thermal head 3 and the platen roller 1.

Next, the platen roller 1, in response to the speed of the image forming by the thermal head 3, is rotated by the rotational force of the platen rotational drive motor, as the thermal head 3 melts the stencil sheet 4 to form perforations therein in accordance with the image information of the original.

That is, the stencil sheet 4 is transported by the rotation of the platen roller 1, as the thermal head 3 successively forms perforations therein, responsive to the image information of the original, and at the point at which the entire image information of the original has been formed as perforations, the perforation image formation on the stencil sheet 4 is completed.

SUMMARY OF THE INVENTION

However, the inventor made a further study with regard to an image forming apparatus configured as described above, from which in the image forming mode, as shown in FIG. 2, because the thermal head 3 is in a position at which it presses up against the platen roller 1, the thermal head 3 indeed pressed thereagainst. The platen roller 1 receives the pressure applied at this time by the support shafts 2.

Because the support shafts 2 are supported at their two ends by the main apparatus, a bending moment occurs in the platen roller 1, so that the platen roller 1 sags in the negative Z direction, the maximum sag being at the center thereof, at which the deflection $\delta 1$ occurs.

The thermal head 3 is influenced by this deformation of the platen roller 1, and deflects in the negative Z direction at center by an amount of $\delta 2$.

In this case, because the maximum sag deflection $\delta 1$ of the platen roller 1 is greater than the maximum sag deflection $\delta$ of the thermal head 3, the spacing between the thermal head 3 and the platen roller 1 becomes uneven.

This has the effect of making the pressure on the stencil sheet 4 that is transported and pressed between the thermal head 3 and the platen roller 1 reduced at the center part thereof, at which part it is difficult to obtain a good reproduction of the image information of the original as a perforation image.

The present invention was made after the above-described study, and has as an object to provide an image forming apparatus which can maintain the pressure on the recording medium transported between the head and the platen roller as uniform, and is capable of obtaining good image generation characteristics at the recording medium.

An image forming apparatus according to the present invention is provided with a platen roller, a head capable of being pressed against the platen roller and forming an image onto a recording medium, a first impelling member impelling so as to press the head against the platen roller, an impelling roller capable of being pressed against the platen roller, and a second impelling member impelling so as to press the impelling roller against the platen roller. Here, while the head is pressed against the platen roller by use of the first impelling member and the recording medium supplied between the head and the platen roller is pressed, and while the impelling roller is pressed against the platen roller by use of the second impelling member, the recording medium is transported as the image is formed on the recording medium.

DESCRIPTION OF THE PREFERRED EMBODIMENTS

Embodiments of an image forming apparatus according to the present invention are described in detail below, with reference made to relevant accompanying drawings.

In each of the embodiments to be described, the image forming apparatus is applied to a stencil printing machine, this being described for the case in which the image forming apparatus functions as a stencil making unit of the stencil printing machine.

First, the first embodiment of the present invention will be described in detail below, with reference being made to FIG. 3 and FIG. 4.

Figure 1:
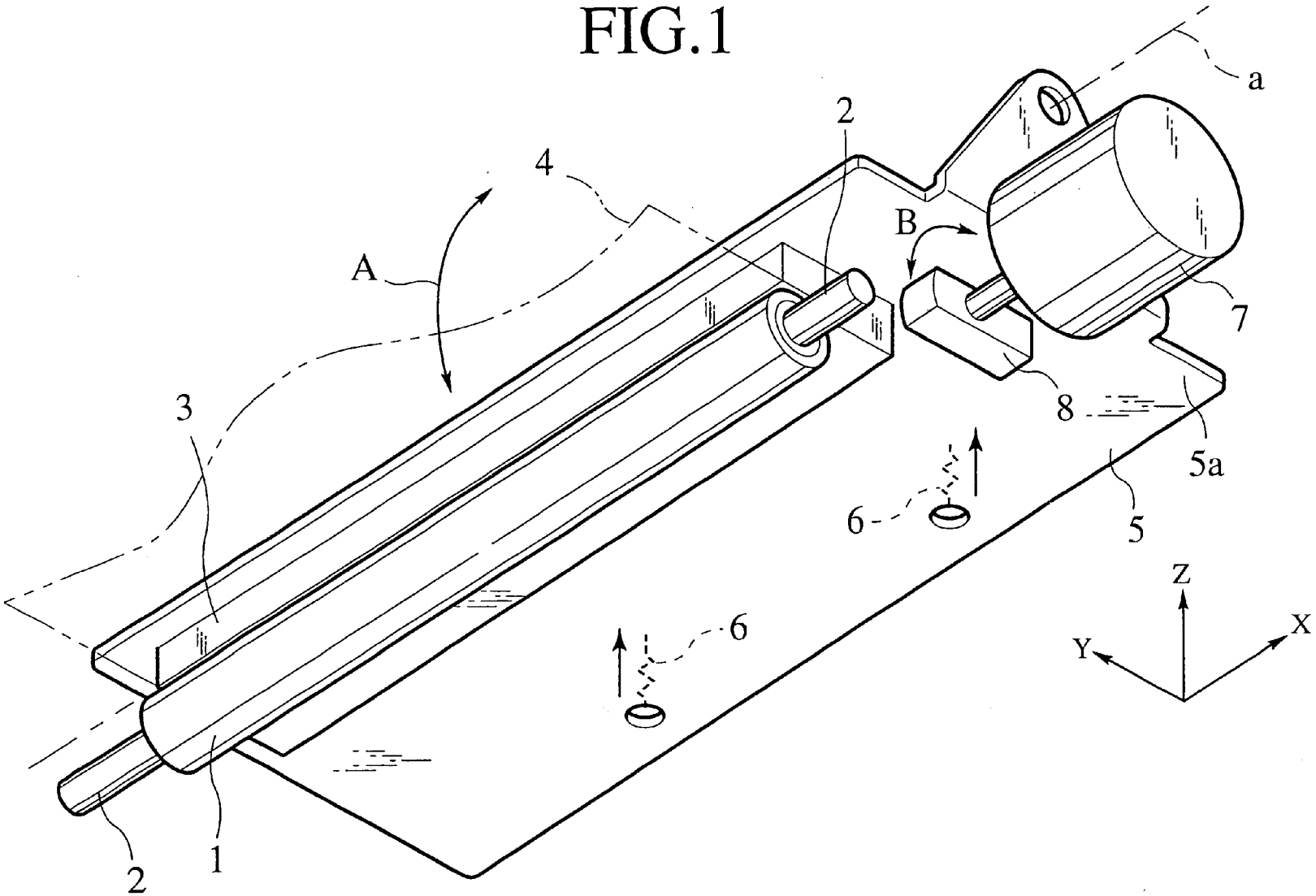
FIG. 1 is a perspective view of the main part of an image forming apparatus studied by the inventor.
Figure 2:
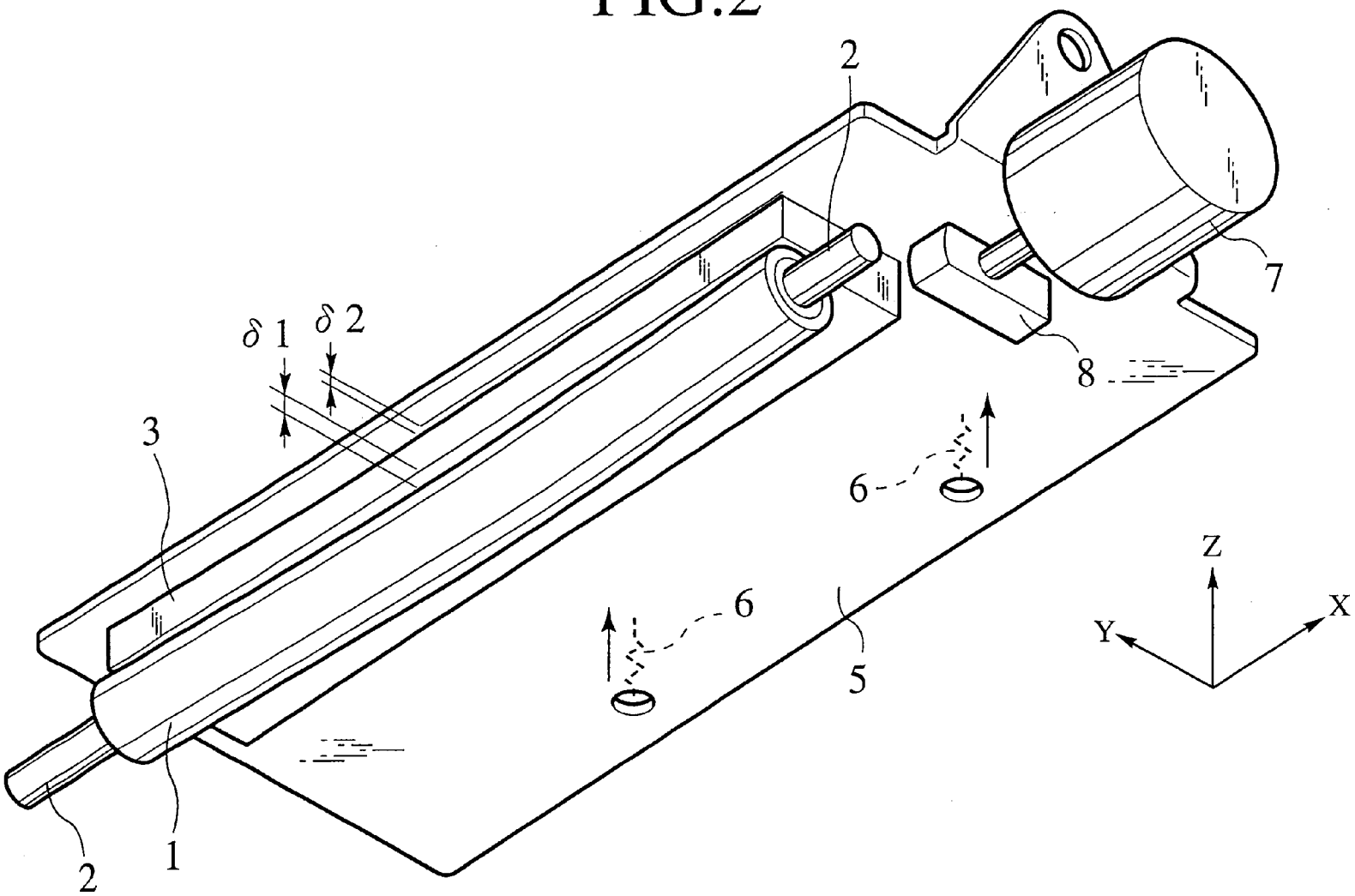
FIG. 2 is a perspective view showing the sagging condition of the thermal head and platen roller in the image forming apparatus studied by the inventor.
Figure 3:
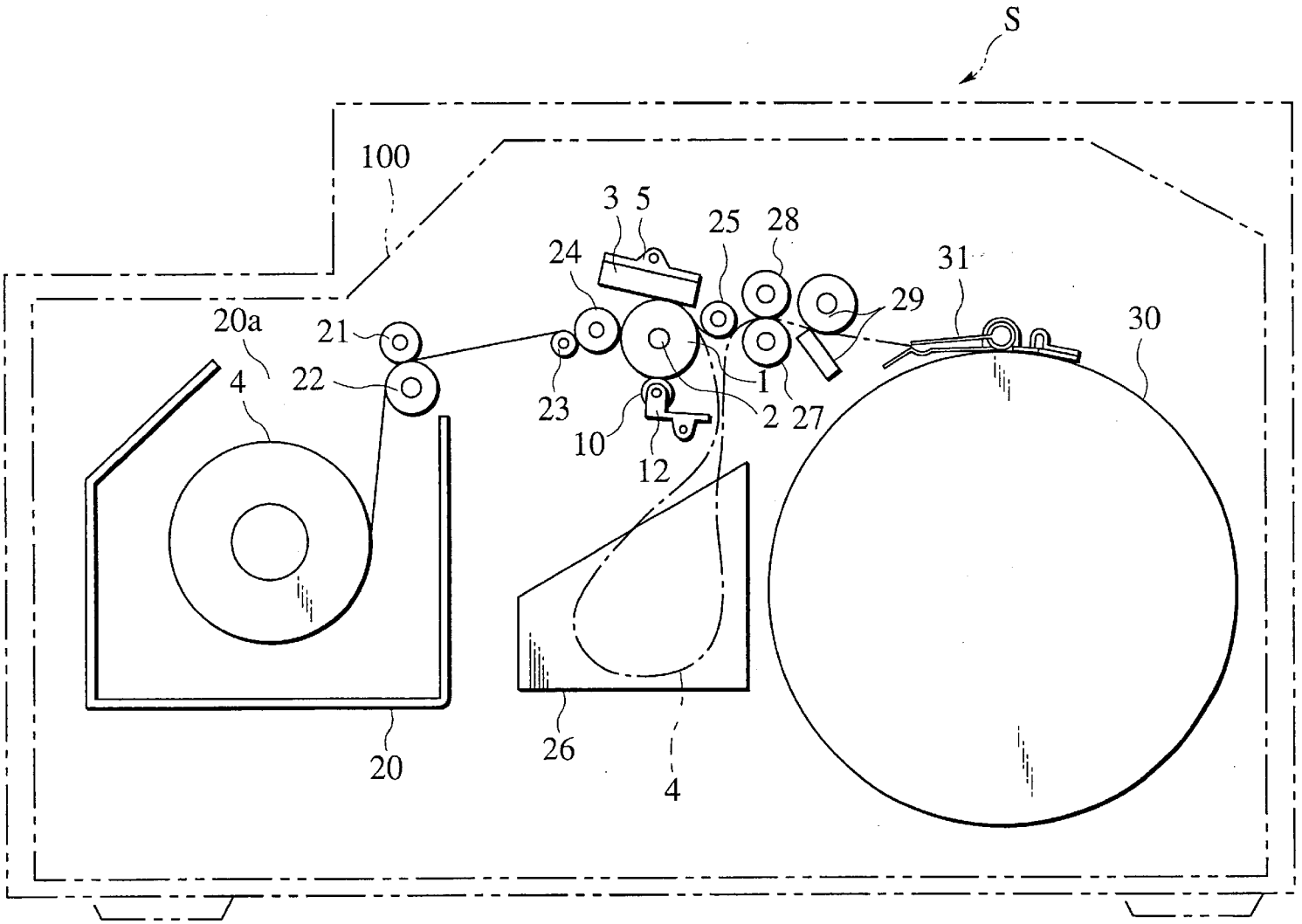
FIG. 3 is a drawing showing the configuration of the main part of a stencil printing machine to which an image forming apparatus according to a first embodiment of the present invention is applied.
Figure 4:
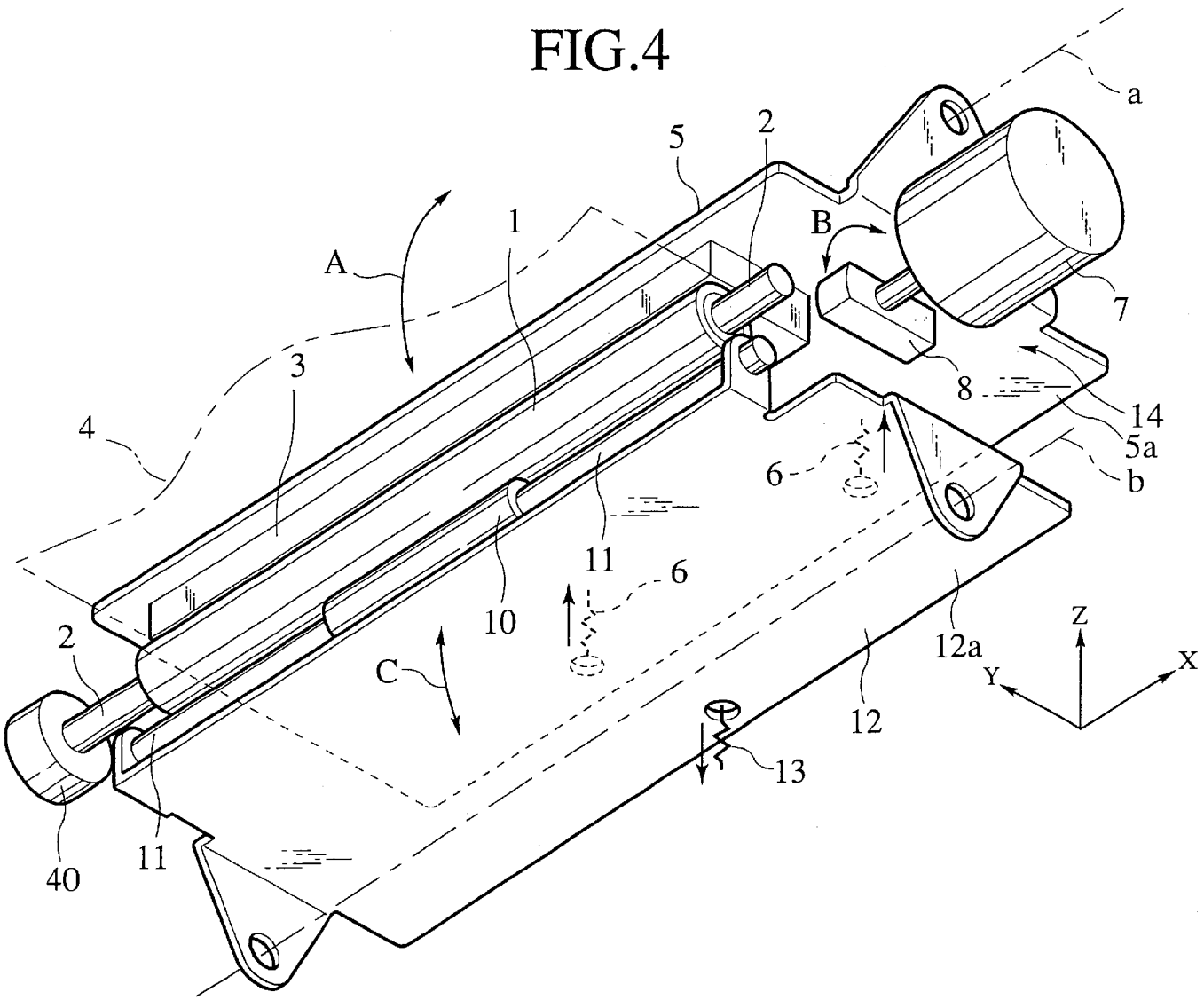
FIG. 4 is a perspective view showing the main part of the image forming apparatus according to the first embodiment of the present invention.

As shown in FIG. 3 and FIG. 4, inside the main apparatus 100 of the stencil printing machine S a stencil sheet holder is provided, a roll-configured stencil sheet 4, corresponding to a recording medium of the image forming apparatus being housed in the stencil sheet holder 20, so as to rotate freely.

The stencil sheet 4 is in the form of a sheet made by adhering together a thermoplastic resin film and an ink permeable porous sheet.

Directed downstream in the transport direction from the stencil sheet holder 20 are sequentially provided a freely rotating nip roller 21 disposed at the opening 20*a* at the top of the stencil sheet holder 20, a nip roller 21, a tension roller 22, a freely rotating set guide shaft 23 and center roller 24, and a platen roller 1 and thermal head 3 (thermal printing head).

The end of the stencil sheet 4 successively feeds through the nip roller 21 and tension roller 22, and the set guide shaft 23 and center roller 24, and is then guided by the platen roller 1 and the thermal head 3.

Facing downstream in the transport direction from the platen roller 1 and the thermal head 3 is provided a freely rotating takeup roller 25, and at the bottom of the takeup roller 25 is disposed a storage box 26 into which an arriving stencil sheet 4 is temporarily stored as shown by the broken line.

The pair of freely rotating load rollers 27 and 28 are disposed above the storage box 26 and also on the opposite side of the platen roller 1 from the takeup roller 25. The lower roller 27 of the pair of load rollers 27 and 28 is caused to rotate by the rotational drive force of a load roller drive motor (not shown in the drawing).

Facing downstream in the transport direction from the pair of freely rotating load rollers 27 and 28 is provided a stencil cutter 29. The stencil cutter 29 cuts the stencil sheet 4 so as to correspond to one master.

The configuration described up until this point is included in the image information apparatus, and especially the parts of the platen roller 1, thermal head 3, and the impelling roller 10 are the main parts of the image forming apparatus. The main parts of the image forming apparatus also include a pressure contact releasing mechanism, which is described later.

Directed downstream in the transport direction from the stencil cutter 29 is provided a freely rotatable printing drum 30. The outer periphery of the printing drum 30 is made of a member of porous construction that passes ink, and this drum is rotated by the driving force of a printing drum drive motor (not shown in the drawing).

A clamp 31 is provided on the periphery of the printing drum 30, this clamp 31 clamping the end of one master of the stencil sheet 4 that is transported from the stencil cutter 29 so as to wind it therearound.

Next, the configuration with regard to the platen roller 1, the thermal head 3, the impelling roller 10, and the pressure contact releasing mechanism 14 are described in detail below, with reference being made to FIG. 4 mainly.

In FIG. 4, the platen roller 1 is fixed by support shafts 2 that extend from both sides thereof in the X direction. The protruding ends of the support shafts 2 are rotatably supported by the main apparatus 100. The support shafts 2 are linked to a platen rotational drive motor 40, the rotational drive of the platen rotational drive motor 40 causing the platen roller 1 to rotate.

The thermal head 3 has a rectangular shape with a longitudinal direction in the direction of the axis of the platen roller 1, that is, the X direction. The thermal head 3 melts the stencil sheet 4 based on image information of the original, and perforates it, and is supported by the head support member 5.

The head support member 5 is swingably supported to the main apparatus so that it can swing about the axis a parallel to the X direction. The swinging of the head support member 5 freely moves the thermal head 3 with respect to the platen roller 1 in the contact and retraction directions indicated by the arrow A.

One end of a first spring 6 is engaged with the head support member 5. The spring force of the first spring 6 impels the thermal head 3 so that it is pressed against the platen roller 1.

The pressure adjustment cam 8 is fixed to the output shaft of the head pressure adjustment motor.

The pressure adjustment cam 8 has a rectangular shape with appropriate radii R imparted to the corner parts thereof, the rotational force of the head pressure adjustment motor 7 causing rotation in both directions shown by the arrow B, being placed in the engaged or disengaged condition with respect to the head support member 5, in response to the rotational position thereof. In FIG. 4, the example position shown is that of the disengaged condition, in which the longitudinal direction of the pressure adjustment cam 8 is aligned with the Y direction.

Specifically, the when the pressure adjustment cam 8 rotates so that its longitudinal direction rotates from the Y direction, which is the width direction of the head support member 5, so as to make contact with the bottom surface 5*a* in the Z direction, which is perpendicular thereto, the pressure adjustment cam 8 presses up against the bottom surface 5*a* of the head support member 5, and the head support member 5 resists the spring force of the first spring 6, rotating in the clockwise direction as shown in FIG. 4. Therefore, the thermal head 4 fixed to the head support member 5 moves to a position that is retracted from the platen roller 1.

When the pressure adjustment cam 8 rotates so that its longitudinal direction moves from the Z direction to the Y direction, the pressure of the pressure adjustment cam 8 up against the head support member 5 is released, so that, by means of the spring force of the first spring 6, the head support member 5 rotates in the counterclockwise direction shown in FIG. 4. Therefore, the thermal head 3 moves to a position that comes into pressure contact with the platen roller 1.

At a position on the other side of the thermal head 3 from the platen roller 1 (position rotated 180 degrees with respect to the thermal head 3), this position corresponding to the center of the platen roller 1 in the axial direction, is disposed an impelling roller 10, which is shorter in the axial direction than the platen roller 1 and extends in that axial direction.

The impelling roller 10 is made, for example, of rubber, and fixed to protruding support shafts 11 that extend from either side thereof, the length in the axial direction thereof being ⅓ of the axial-direction length of the platen roller 1, and this impelling roller 10 making an elastic pressure contact with the center part of the platen roller 1. The axial direction length of the impelling roller 10 in this embodiment, of course, is envisioned as being appropriately shorter than the platen roller 1, the length not been restricted, as long as it can provide a pressure contact at the center part of the platen roller 1.

The end parts that protrude from the support shafts 11 are rotatably supported by the roller support member 12.

The roller support members 12 are swingably supported by the main apparatus 100 so that they can swing about the axis b parallel to the X direction and as a center. The swing of the swing of the roller support member acts to freely move the impelling roller 10 in the contact and retracting directions indicated by the arrow C, with respect to the platen roller 1. Here, the axis of the platen roller 1, the axis a of the head support member 5, the axis of the impelling roller 10, and the axis b of the roller support member 12 are all mutually parallel in the X direction.

One end of a second spring 13 is engaged with the roller support member 12. By the spring force of the second spring 13, the impelling roller 10 is pressed in the Z direction towards the thermal head 3 in the center region of the platen roller 1.

The pressure adjustment cam 8, in response to the rotational direction indicated by the arrows B, engages with both the bottom surface 5*a* of the head support member 5 and the bottom surface of the roller support member 12.

Specifically, the position in which the longitudinal direction of the pressure adjustment cam 8 in the Z direction, this being the position in which it is perpendicular to the bottom surface 5*a* of the head support member 5 and the roller support member 12, is established as the position at which the pressure contact is released, and the position in which the longitudinal direction of the pressure adjustment cam 8 is in the Y direction, this being the position in which it is parallel to the bottom surface 5*a* of the head support member 5 and the roller support member 12, is established as the position at which the pressure contact is permitted.

That is, when the pressure adjustment cam longitudinal direction rotates from the Y direction to the Z direction, the pressure adjustment cam 8 presses the head support member 5, and the head support member 5 resists the spring force of the first spring 6, rotating in the clockwise direction shown in FIG. 4, that the thermal head 3 is moved to the position at which it is retracted from the platen roller 1. At the same time, the pressure adjustment cam 8 presses the roller support member 12, so that the roller support member 12 resist the spring force of the second spring 13, rotating in the counterclockwise direction shown in FIG. 4, so that the impelling roller 10 moves to a position in which it is retracted from the platen roller 1.

When the pressure adjustment cam longitudinal direction rotates from the Z direction to the Y direction, the pressure adjustment cam 8 releases the pressure on the head support member 5, so that the head support member 5, responsive to the spring force of the first spring 6, rotates in the counterclockwise direction in FIG. 4, the thermal head 3 moving to a position in which it presses against the platen roller 1. At the same time, the pressure adjustment cam 8 releases the pressure on the roller support member 12, and the roller support member 12, by spring force of the second spring 13, rotates in the clockwise direction shown in FIG. 4, so that the impelling roller 10 moves to the position at which it presses against the platen roller 1. That is, the impelling roller 10 substantially coincides with the center part of the platen roller 1 in the axial direction and the length thereof with respect to the center of the platen roller 1 on either side of the center is substantially ⅙ each of the platen roller 1 length, so that the impelling roller presses up against the platen roller 1 at its center in the axial direction. The pressure adjustment cam 8 and head pressure adjustment motor 7 substantially correspond to the pressure contact releasing mechanism 14.

In the above-noted configuration, the end of the stencil sheet 4 is guides so as to pass between the nip roller 21 and the tension roller 22, around the upper periphery of the set guide roller 23, around the lower periphery of the center roller 24, between the thermal head 3 and the platen roller 1, and between the takeup roller 25 and the pair of load rollers 27 and 28, and be guided to the stencil cutter 29, and when the thermal head 3 and the impelling roller 10 are in the retracted positions, if the stencil making mode, which is the image forming mode, is selected, the following operation occurs.

First, the head pressure adjustment motor 7 provides drive, so that the thermal head 3 moves from the retracted position to the pressure contact position, the stencil sheet 4 being pressed between the thermal head 3 and the platen roller 1. At the same time, the impelling roller 10 moves from the retracted position to the pressure contact position.

Next, the platen roller 1, in response to the speed of image forming by the thermal head 3, rotates by the rotational drive force of the platen rotational drive motor, as the thermal head 3 melts the stencil sheet 4, in accordance with image information of the original.

Next, the stencil sheet 4 is transported by the rotation of the platen roller 1, as successive perforations are made by the thermal head 3 in locations corresponding to the image information of the original, and at the point at which the entire image information of the original has been formed as perforations, the perforation image formation on the stencil sheet 4 is completed as one master.

Because the thermal head 3 is pressing the platen roller 1 toward the impelling roller 10, the platen roller 1 receives pressure from the thermal head 3, and the impelling roller 10 is pressing the platen roller 1 toward the thermal head 3, so that the pressure from the impelling roller 10 also is applied. This force from the thermal head 3 and force from the impelling roller 10 are mutually opposing, canceling out, so that even at the center region of the platen roller 1, there is effective suppression of sagging deformation.

Therefore, the phenomenon of the force on the stencil sheet 4 held between the thermal head 3 and the platen roller 1 being reduced at the center in the axial direction is effectively suppressed, the thus obtained perforation image being a faithful representation of the original image.

Next, the stencil sheet 4 onto which the perforation image has been formed is guided by the takeup roller 25 into the storage box 26, in which it is temporarily stored.

Next, by the action of the rotation of the load roller 27, stencil sheet 4, onto which is formed a perforation image, including the contents of the storage box 26, is transported toward the printing drum 30, the end of the stencil sheet 4 being clamped by the clamp 31.

Next, with the stencil sheet 4 in the clamped condition, the printing drum 30 rotates, so that the stencil sheet 4 is wound around the outer periphery of the printing drum 30, a prescribed position on the stencil sheet 4 , this being a position upstream in the transport direction from the part thereof onto which is formed the perforation image, being cut by the stencil cutter 29.

Next, the printing drum 30 rotates, and in synchronization with the rotation of the printing drum 30 printing paper is transported in from a supply unit (not shown in the drawing).

Then, the printing paper that arrives as noted above is pressed to the printing drum 30, and ink is transferred to the printing paper via the perforated parts of the stencil sheet 4, a prescribed number of sheets being printed in this manner.

After the above, with the printing mode selected and the number of sheets to be printed set, when the printing start key is pressed, the set number of sheets are printed.

In the embodiment of the present invention configured as described above, in the stencil making mode there is effective suppression of sagging deformation of the platen roller 1, and the achievement of uniform force between the thermal head 3 and the platen roller 1, that is, the force applied to the stencil sheet, over the entire axial direction, the result being the achievement of a perforation image with superiority fidelity to the origin image information.

The achievement of uniform holding force between the thermal head 3 and the platen roller 1 with respect to the axial direction thereof also has the effect of preventing skewed feed and wrinkling when feeding the stencil sheet 4, thereby enabling the achievement of a perforation image with even better fidelity to the image information.

Because the impelling roller 10 rotates with good tracking to the rotation of the platen roller 1, it substantially does not place a rotational load on the platen roller 1.

Because the impelling roller 10, by pressing up against the center part of the platen roller 1, effectively suppresses sagging deformation of the platen roller 1, it is possible to set the impelling roller 10 pressure to a small value, thereby reducing the load on constituent parts. That is, in addition to achieving a configuration with good durability, it is possible to make the length of the impelling roller 10 itself short in the axial direction, thereby reducing cost.

Because in modes other than the stencil making mode by the action of the pressure contact releasing mechanism 14 the impelling roller 10 does not press on the platen roller 1, it is possible to avoid plastic deformation of the platen roller 1 and thermal head 3, for example, as much as possible.

Because a single pressure adjustment cam 8 performs both movement of the thermal head 3 and movement of the impelling roller 10, the mechanism is simple and low in cost.

Next, a second embodiment of the present invention is described below.

In this embodiment, the different with respect to the first embodiment is the configuration of the impelling roller 10, with other parts of the configuration being the same. Elements of the second embodiment corresponding to elements in the first embodiment are assigned the same reference symbols, and are not explicitly described herein.

Figure 5:
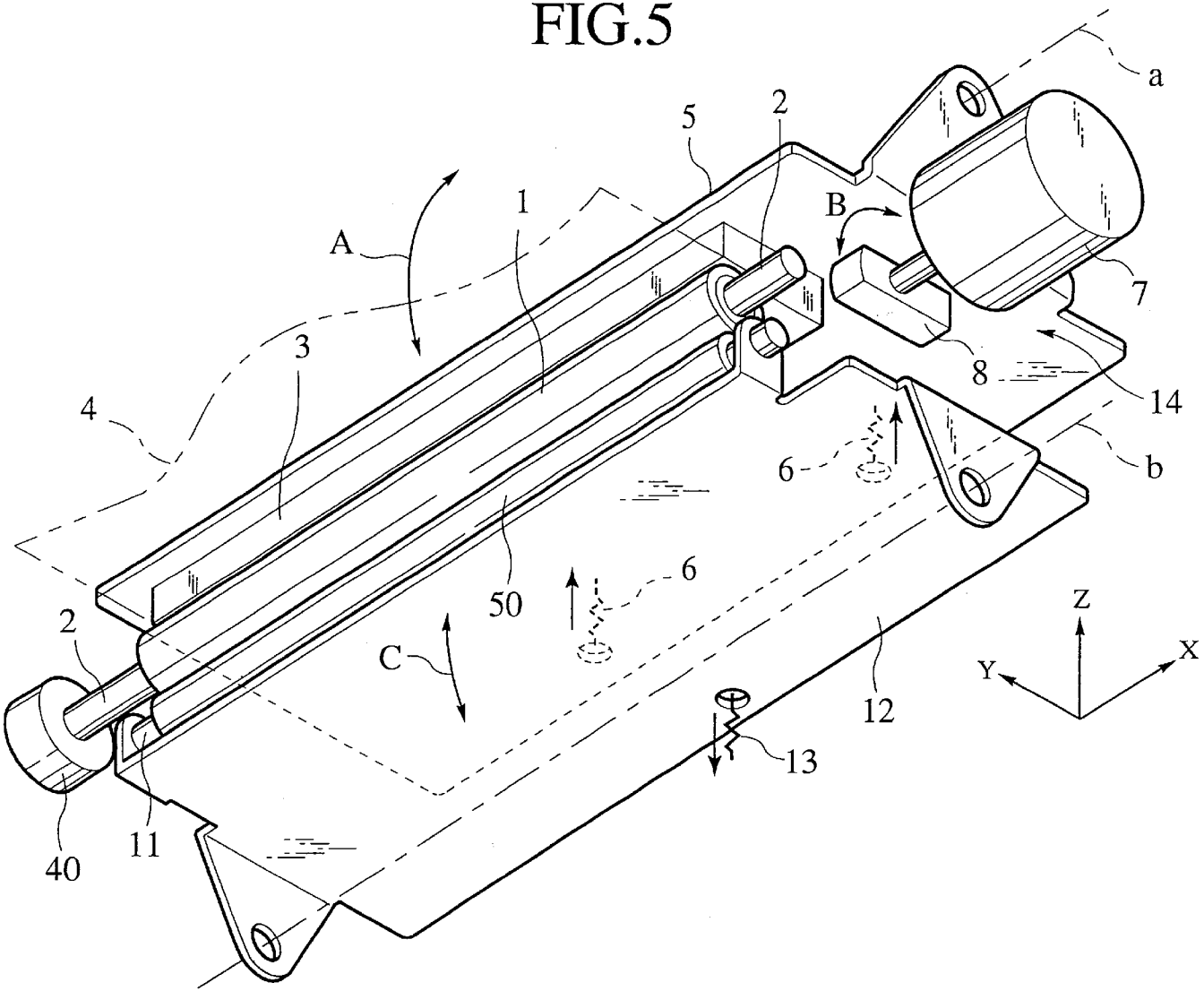
FIG. 5 is a perspective view showing the main part of an image forming apparatus according to a second embodiment of the present invention.

As shown in FIG. 5, the axial direction length of the impelling roller 50 in this embodiment is substantially the same as the axial direction length of the platen roller 1, so that the ends of the impelling roller 50 and the platen roller 1 substantially coincide.

In this embodiment, therefore, because the impelling roller 50 presses the entire platen roller 1, it is possible in a case in which sagging deformation of the platen roller 1 occurs over a broad range in the axial direction, or in which sagging deformation of the thermal head 3 occurs over a broad range in the longitudinal direction, to effectively suppress this sagging deformation, thereby achieving a perforation image having superior fidelity to the original image information.

Next, the third embodiment of the present invention is described below.

In this embodiment as well, the difference with respect to the first embodiment is a change in the configuration of the impelling roller 10, with other parts being the same. Elements of the third embodiment corresponding to elements in the first embodiment are assigned the same reference symbols, and are not explicitly described herein.

Figure 6:
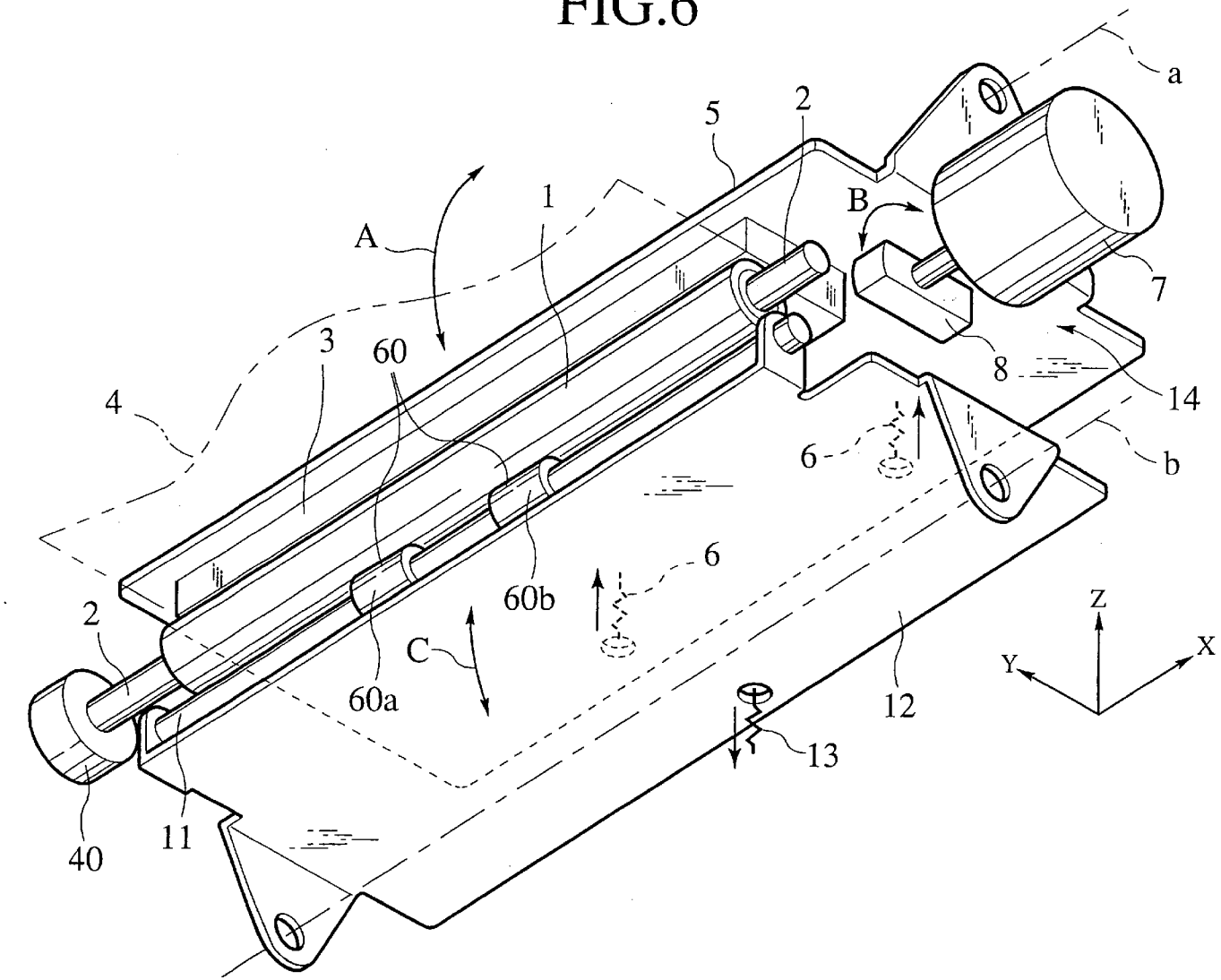
FIG. 6 is a perspective view showing the main part of an image forming apparatus according to a third embodiment of the present invention.

As shown in FIG. 6, the impelling roller 60 presses the platen roller 1 in the center region, but the impelling roller 60 is divided into two rollers 60*a* and 60*b*. The rollers 60*a* and 60*b* are disposed symmetrically about the center of the impelling roller 60 in the axial direction, and separated from one another.

It is therefore possible, in this embodiment, to make the length of the impelling roller 60 shorter, so that, while achieving a perforation image with superior fidelity to the original image information, it is possible to reduce cost.

It will be understood that the number of divisions of the impelling roller 60 in this embodiment is not restricted to two, and can be, as required, some higher number, as long the impelling roller presses up against the platen roller 1 at the center region thereof.

In the foregoing embodiments of the present invention, while the description was for the case of application of the image forming apparatus to a stencil making unit in a stencil printing machine, it will be understood that the present invention can be applied to other cases in which heat is used for recording, for example it can be applied a printer head of a printer in which images are formed by printing onto thermally sensitive paper.

Additionally, while the pressure contact releasing mechanism in the foregoing embodiments is formed by a pressure adjustment cam and pressure adjustment motor, it is possible to have an alternate configuration in which the thermal head and the impelling roller are appropriately movable, and the configuration can make use of an element other than a cam.

Although the foregoing embodiments has been described for the case in which both of the members that impel the head support member 5 and the roller support member 12 are springs, it is alternately possible to use a type of impelling member other than a spring, as long as it is capable of impelling at thermal head 3 and the impelling roller 10 at the pressure contact position.

Also, although the invention has been described above by reference to certain embodiments of the invention, the invention is not limited to such embodiments described above. Of course, modifications and variations with respect to the embodiments described above will occur to those skilled in the art, in light of the teachings. The scope of the invention is defined with reference to the following claims.

What is claimed is:

1. An image forming apparatus comprising:

a platen roller;

a head to be pressed against the platen roller, and forming an image onto a recording medium;

a first impelling member impelling so as to press the head against the platen roller;

an impelling roller to be pressed against the platen roller;

a second impelling member impelling so as to press the impelling roller against the platen roller; and a pressure contact releasing mechanism resisting an impelling force of the second impelling member to hold the impelling roller in a waiting position in which the impelling roller does not press against the platen roller;

wherein while the head is pressed against the platen roller by use of the first impelling member and the recording medium supplied between the head and the platen roller is pressed, and while the impelling roller is pressed against the platen roller by use of the second impelling member, the recording medium is transported as the image is formed thereonto; and wherein the pressure contact releasing mechanism resists an impelling force of the first impelling member to hold the head in a position in which the head does not press against the platen roller.

2. An image forming apparatus according to claim 1, wherein the pressure contact releasing mechanism has a cam moving between a pressure contact release position and a pressure contact permitting position, and wherein when the cam is in the pressure contact release position the head is caused to be positioned at the waiting position thereof and the impelling roller is caused to be positioned at the waiting position thereof, and when the cam is in the pressure contact permitting position, by use of the impelling force of the first impelling member the head is pressed against the platen roller, and by use of the impelling force of the second impelling member the impelling roller is pressed against the platen roller.

3. An image forming apparatus according to claim 2, wherein the cam has a rectangular shape.

4. An image forming apparatus according to claim 1, wherein the first impelling member impels a first supporting member supporting the head, and the second impelling member impels a second supporting member supporting the impelling roller.

5. An image forming apparatus according to claim 1, wherein the impelling roller presses on an axially centrally disposed surface of the platen roller in a radial direction thereof.

6. An image forming apparatus according to claim 5, wherein the impelling roller is divided into a plurality of parts mutually separated along an axial direction thereof.

7. An image forming apparatus according to claim 1, wherein the impelling roller presses on a substantially entire axially disposed surface of the platen roller in a radial direction thereof.

8. An image forming apparatus according to claim 1, wherein the impelling roller is disposed on an other side of the head from the platen roller.

9. An image forming apparatus according to claim 1, wherein the image is formed onto a stencil sheet as the recording medium.

10. An image forming apparatus according to claim 1, wherein the head is a thermal printing head.

11. An image forming apparatus according to claim 1, wherein the platen roller rotates in response to a speed of image formation by the head, so as to transport the recording medium as the image is formed thereonto.

* * * * *